US005548186A

United States Patent [19]

Ota

[11] Patent Number: 5,548,186

[45] Date of Patent: Aug. 20, 1996

[54] BUS ELECTRODE FOR USE IN A PLASMA DISPLAY PANEL

[75] Inventor: Tatsuki Ota, Tokyo, Japan

[73] Assignee: NEC Corporation, Tokyo, Japan

[21] Appl. No.: 300,804

[22] Filed: Sep. 6, 1994

[30] Foreign Application Priority Data

Sep. 6, 1993 [JP] Japan ..... 5-220745

[51] Int. Cl.[6] ..... H01J 17/49

[52] U.S. Cl. ..... 313/583; 313/586; 313/587

[58] Field of Search ..... 313/583, 484, 313/491, 518, 586, 587; 345/169.4; 174/255, 258

[56] References Cited

U.S. PATENT DOCUMENTS 4,803,402 2/1989 Raber et al. ..... 313/587

5,182,489 1/1993 Sano .

*Primary Examiner*—Sandra L. O'Shea
*Assistant Examiner*—Vip Patel
*Attorney, Agent, or Firm*—Popham, Haik, Schnobrich & Kaufman, Ltd.

[57] ABSTRACT

In a plasma display having a thick bus electrode provided on a transparent electrode which is arranged on a glass substrate, the bus electrode and the transparent electrode are covered by first and second dielectric layers. The first dielectric layer has a softening point higher than that of the second dielectric layer. Otherwise, the first dielectric layer is fired at a temperature lower than a temperature at which the second dielectric layer is fired.

4 Claims, 3 Drawing Sheets

BUS ELECTRODE FOR USE IN A PLASMA DISPLAY PANEL

FIELD OF THE INVENTION

The invention relates to a plasma display panel, and more particularly to, a plasma display panel of high brightness having fine and precise electrodes.

BACKGROUND OF THE INVENTION

It is important to enhance a light take-out efficiency in increasing a luminous efficiency of a flat display panel such as a plasma display panel, a liquid crystal display panel, etc.

For this purpose, electrodes using transparent conductive films are widely used for such flat display panels. In practical use, however, almost all of the transparent conductive films have high resistance values. Especially, a transparent conductive film itself is difficult to be used for a fine and precise electrode which is patterned in a plasma display panel by a long distance. For this reason, the transparent conductive film is combined in most cases with a low resistive material to lower the electric resistance. In general, such a low resistive material is layered on the transparent conductive film in a plasma display panel, wherein the low resistive material is specified as "bus electrode".

A conventional bus electrode is thin so that it can be formed on a transparent conductive film, wherein the transparent conductive film is deposited on a glass substrate by using tin oxide in the CVD process, and the bus electrode is deposited on the transparent conductive film by using aluminum in a thin film formation process such as the sputter process. The deposited transparent conductive film and bus electrode are covered by a thick dielectric layer of a low melting point glass which is printed in the screen printing process, and then fired.

Practically, however, the bus electrode is preferably as thick as possible, because a thick bus electrode increases the productivity and facilitates a large area.

In this point, a conventional plasma display panel has a disadvantage in that it is difficult to make a bus electrode thick, because a thick bus electrode floats on a printed dielectric layer above a transparent conductive film as a result of erosion of the electric layer between the bus electrode and the transparent conductive film during firing of the printed dielectric layer.

SUMMARY OF THE INVENTION

Accordingly, it is an object of the invention to provide a thick bus electrode which is not split from a transparent conductive film for use in a plasma display panel.

It is a further object of the invention to provide a plasma display panel of high brightness having fine and precise electrodes.

It is a still further object of a plasma display panel of a large area which is fabricated with a high productivity and a low cost.

The bus electrode according to the invention comprises:

a glass substrate for transmitting visible rays; transparent electrodes formed on said glass substrate; electrodes of thick film conductive paste formed on said transparent electrodes; and a dielectric layer for covering said transparent electrodes and said electrodes of thick film conductive paste.

The dielectric layer comprises: a first dielectric layer of thick film paste being of a low melting point glass as a main component, said first dielectric layer covering said transparent electrodes and said electrodes of thick film conductive paste; and a second dielectric layer of thick film paste being of a low melting point glass having a softening point lower than that of said low melting point glass of said first dielectric layer, said second dielectric layer being provided on said first dielectric layer and having a top surface which is made smooth by firing.

BRIEF DESCRIPTION OF THE DRAWINGS

The invention will be explained in more detail in conjunction with appended drawings, wherein.

DESCRIPTION OF THE PREFERRED EMBODIMENTS

Before describing a plasma display panel in a preferred embodiment according to the invention, the aforementioned conventional bus electrode for a plasma display panel will be explained.

Figure 1A:
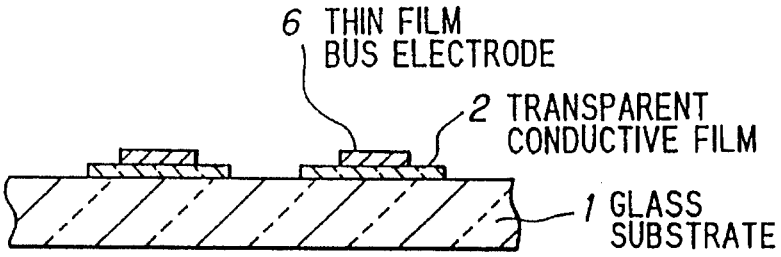
FIG. 1A PRIOR ART
FIGS. 1A and 1B are schematic cross-sectional views showing a process for fabricating a thin bus electrode in a conventional plasma display panel.
Figure 1B:
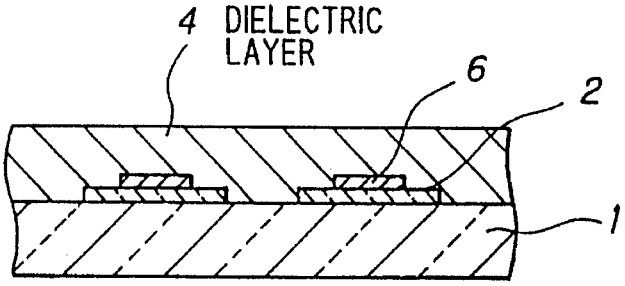
FIG. 1B PRIOR ART

FIGS. 1A and 1B show a process for fabricating the conventional bus electrode for a plasma display panel which is shown in, for instance, the U.S. Pat. No. 5,182,489.

In FIG. 1A, a transparent conductive film 2 is formed in a predetermined pattern on a glass substrate 1 by using tin oxide as a main component in the CVD process, and a thin film bus electrode 6 is formed on the transparent conductive film 2 by using a low resistive metal such as aluminum in a thin film formation process such as the sputter process.

In FIG. 1B, a thick dielectric layer 4 is formed to cover the transparent conductive film 2 and the thin film bus electrode 6 by using paste of a low melting point glass which is printed and then fired on the glass substrate 1 in the screen printing process.

In this conventional bus electrode for the plasma display panel, the bus electrode 6 is preferably as thick as possible to increase the productivity and enlarge an area thereof, although the bus electrode 6 is thin in FIGS. 1A and 1B.

Figure 2:
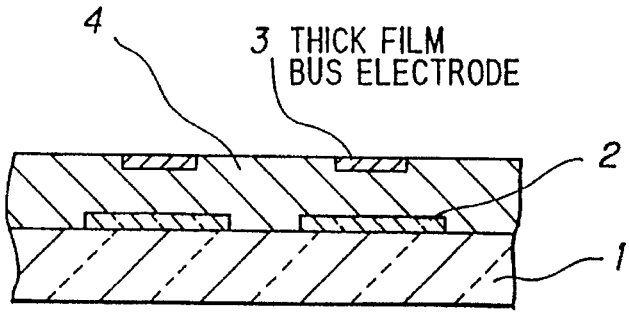
FIG. 2 PRIOR ART
FIG. 2 is a schematic cross-sectional view showing a disadvantage in a thick bus electrode in a conventional plasma display panel.

As shown in FIG. 2, however, the low melting point glass dielectric layer 4 erodes between thick thick film bus electrode 3 and the transparent conductive film 2, so that the thick film bus electrode 3 floats thereon above the transparent conductive film 2 at the step where the pasted dielectric layer 4 is fired.

Next, a plasma display panel in the first preferred embodiment according to the invention will be explained. In the plasma display panel, a thick bus electrode is fabricated as illustrated in FIGS. 3A to 3D.

Figure 3A:
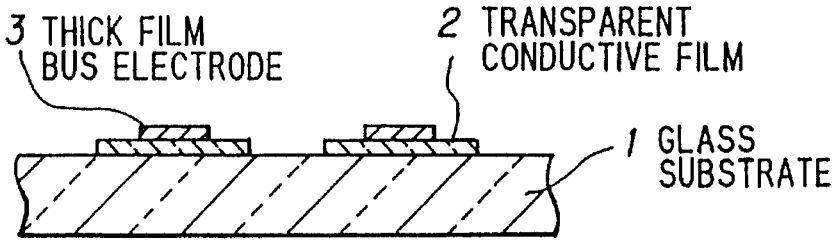
FIGS. 3A to 3D are schematic cross-sectional views showing a process for fabricating a bus electrode for use in a plasma display panel in a first preferred embodiment according to the invention.

In FIG. 3A, a transparent conductive film 2 of tin oxide, that is, mesa is deposited in a predetermined pattern on a glass substrate 1, and a thick bus electrode 3 of silver as a main component is formed on the transparent conductive film 2 by using silver paste which is printed in the screen printing process and is then fired at 550° C.

Figure 3B:
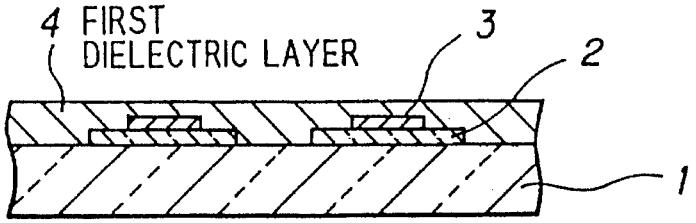

In FIG. 3B, a first dielectric layer 4 of a low melting point glass having a softening point of approximately 520° C. as a main component is formed to cover the transparent conductive film 2 and the thick bus electrode 3 by using a thick film paste which is printed in the screen printing process and is provisionally fired at 120° C.

Figure 3C:
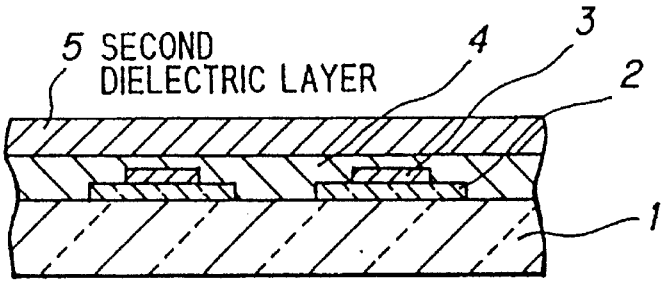

In FIG. 3C, a second dielectric layer 5 having a softening point of approximately 480° C. as a main component is formed on the first dielectric layer 4 by using paste which is printed and is provisionally fired at 120° C.

Figure 3D:
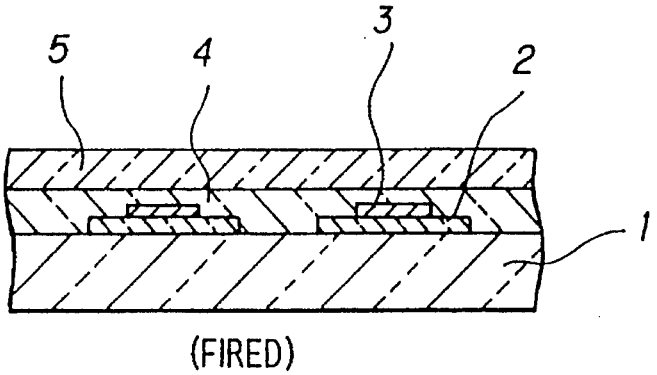

In FIG. 3D, the product thus obtained in FIGS. 3A to 3C is fired at 600° C. to provide a smooth surface thereon.

Then, the product thus fabricated in FIGS. 3A to 3D is assembled with a separate substrate (not shown) to provide a space therebetween into which mixed gases of He and Xe are supplied, and the space containing the mixed gases is sealed from the exterior.

In operation, AC pulse voltages having different phases are applied over each two adjacent electrodes each comprising the transparent conductive film 2 and the thick bus electrode 3. Thus, discharge occurs between the two adjacent electrodes to result in luminous radiation.

In the first preferred embodiment, the first dielectric layer 4 has a softening point higher than that of the second dielectric layer 5. As a result, the first dielectric layer 4 does not erode between the thick bus electrode 3 and the transparent conductive film 2. Consequently, the bus electrode 3 is not split from the transparent conductive film 2. Thus, it is not necessary to use the conventional thin film formation process, which would increase like a fabricating cost.

In the first preferred embodiment, the first and second dielectric layers 4 and 5 can be thin, when the firing is carried out at each time of forming the first and second dielectric layers 4 and 5. In such a case, the amount of foams generated in the dielectric layers 4 and 5 is suppressed. As a matter of course, three or more dielectric layers may be formed in place of the first and second dielectric layers 4 and 5.

A plasma display panel in the second preferred embodiment according to the invention will now be explained. In the plasma display panel, a thick bus electrode is fabricated as illustrated in FIGS. 4A to 4E.

Figure 4A:
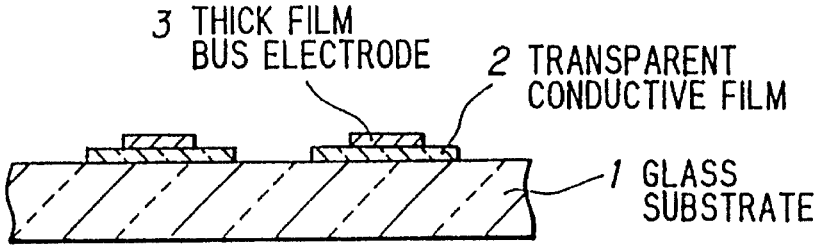
FIGS. 4A to 4E are schematic cross-sectional views showing a process for fabricating a bus electrode for use in a plasma display panel in a second preferred embodiment according to the invention.

In FIG. 4A, a transparent conductive film 2 of tin oxide, that is, mesa is deposited in a predetermined pattern on a glass substrate 1, and a thick bus electrode 3 of silver as a main component is formed on the transparent conductive film 2 by using silver paste which is printed in the screen printing process and is then fired at 550° C.

Figure 4B:
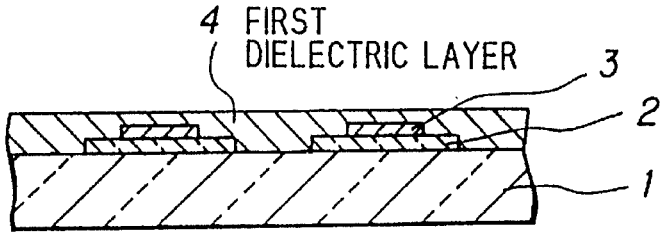

In FIG. 4B, a first dielectric layer 4 of a low melting point glass having a softening point of approximately 480° C. as a main component is formed to cover the transparent conductive film 2 and the thick bus electrode 3 by using a thick film paste which is printed in the screen printing process.

Figure 4C:
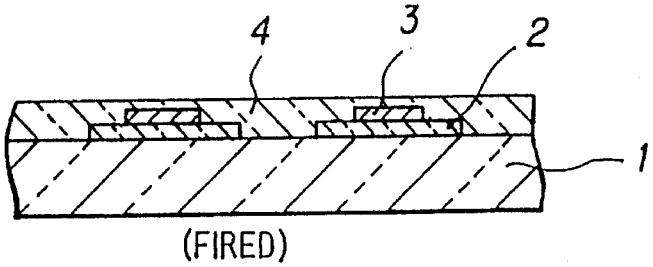

In FIG. 4C, the first dielectric layer 4 is fired at 500° C.

Figure 4D:
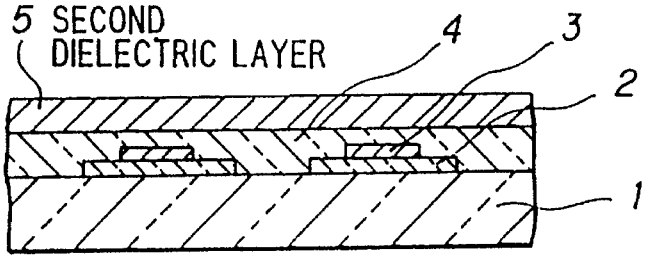

In FIG. 4D, a second dielectric layer 5 having a softening point of approximately 480° C. as a main component is formed on the first dielectric layer 4.

Figure 4E:
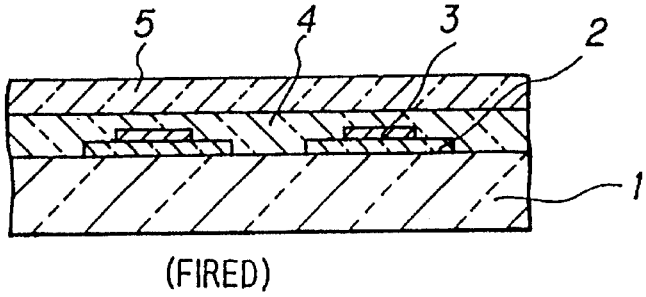

In FIG. 4E, the product thus obtained in FIGS. 4A to 4D is fired at 600° C. to provide a smooth surface thereon.

Then, the product thus fabricated in FIGS. 4A to 4E is assembled with a separate substrate (not shown) to provide a space therebetween into which mixed gases of He and Xe are supplied, and the space containing the mixed gases is sealed from the exterior.

In operation, AC pulse voltages having different phases are applied over each two adjacent electrodes each comprising the transparent conductive film 2 and the thick bus electrode 3. Thus, discharge occurs between the two adjacent electrodes to result in luminous radiation.

In the second preferred embodiment, limitation on paste used for the first dielectric layer 4 is decreased. Therefore, this process is easily introduced in practical use without largely changing a conventional process. Further, the amount of foams generated in the first and second dielectric layers is decreased for the same reason as in the first preferred embodiment.

In an experiment, the first dielectric layer 4 is fired at 580° C. higher than the softening point of 480° C. by 100° C. Then, it is confirmed that the thick bus electrode 3 is split from the transparent conductive film 2.

In the first and second preferred embodiments, the transparent conductive film 2 may be of ITO, AnO, etc., and the thick bus electrode 3 may be fabricated by Ni paste, Pa paste, etc.

Although the invention has been described with respect to specific embodiments for complete and clear disclosure, the appended claims are not to be thus limited but are to be construed as embodying all modification and alternative constructions that may occur to one skilled in the art which fairly fall within the basic teaching herein set forth.

What is claimed is:

1. A bus electrode for use in a plasma display panel, comprising:

a transparent electrode formed on a glass substrate;

a thick film conductive paste electrode on said transparent electrode;

a thick film paste first dielectric layer covering said transparent electrode and said thick film conductive paste electrode, said first dielectric layer comprising a low melting point glass as its main component; and a second dielectric layer formed over said first dielectric layer, said second dielectric layer comprising a low melting point glass having a softening point lower than that of said low melting point glass of said first dielectric layer.

2. The bus electrode of claim 1, wherein:

said second dielectric layer has a top surface that is made smooth by firing.

3. The bus electrode of claim 1, wherein:

said first dielectric layer is fired at a first temperature that is lower than a second temperature at which said first dielectric layer erodes between said thick film conductive paste electrode and said transparent electrode; and said second dielectric layer is fired at a third temperature at which flow occurs on a top surface of said second dielectric to provide a smooth top surface.

4. The bus electrode of claim 3, wherein:

said first temperature is lower than said third temperature.

* * * * *